US008511388B2

(12) United States Patent
Milne

(10) Patent No.: US 8,511,388 B2
(45) Date of Patent: Aug. 20, 2013

(54) DEVICES AND METHODS FOR TRANSMITTING EDS BACK-UP SIGNALS TO SUBSEA PODS

(75) Inventor: Eric Lee Milne, Pearland, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 0 days.

(21) Appl. No.: 12/969,822

(22) Filed: Dec. 16, 2010

(65) Prior Publication Data

US 2012/0152554 A1 Jun. 21, 2012

(51) Int. Cl.
*E21B 7/12* (2006.01)

(52) U.S. Cl.
USPC ..... 166/363; 166/364; 367/83

(58) Field of Classification Search
USPC ..... 166/335, 249, 250.01, 255, 363–364, 166/337; 367/81, 82, 83
See application file for complete search history.

(56) References Cited

U.S. PATENT DOCUMENTS

| | | | | |
|---|---|---|---|---|
| 4,147,222 | A * | 4/1979 | Patten et al. | 175/9 |
| 4,273,212 | A * | 6/1981 | Dorr et al. | 181/102 |
| 4,323,991 | A * | 4/1982 | Holmes et al. | 367/83 |
| 4,880,060 | A * | 11/1989 | Schwendemann et al. | 166/336 |
| 5,163,029 | A * | 11/1992 | Bryant et al. | 367/83 |
| 5,455,804 | A * | 10/1995 | Holmes et al. | 367/83 |
| 6,457,529 | B2 * | 10/2002 | Calder et al. | 166/368 |
| 6,536,529 | B1 * | 3/2003 | Kerr et al. | 166/375 |
| 2002/0100589 | A1 | 8/2002 | Childers et al. | |
| 2004/0089450 | A1 * | 5/2004 | Slade et al. | 166/298 |
| 2005/0115718 | A1 * | 6/2005 | Symons et al. | 166/381 |
| 2005/0199392 | A1 * | 9/2005 | Connell et al. | 166/254.2 |
| 2006/0164918 | A1 * | 7/2006 | Gardner et al. | 367/83 |
| 2007/0205001 | A1 * | 9/2007 | Shuster et al. | 166/380 |
| 2007/0215360 | A1 * | 9/2007 | Shuster et al. | 166/380 |
| 2008/0083564 | A1 * | 4/2008 | Collins | 175/24 |
| 2008/0123470 | A1 * | 5/2008 | Cooper et al. | 367/83 |
| 2009/0090499 | A1 * | 4/2009 | Lewis et al. | 166/52 |
| 2010/0039287 | A1 * | 2/2010 | Li | 340/855.7 |
| 2010/0155073 | A1 * | 6/2010 | Blank et al. | 166/338 |

FOREIGN PATENT DOCUMENTS

| | | | |
|---|---|---|---|
| GB | 2368861 | A | 5/2002 |
| WO | 0043632 | A2 | 7/2000 |
| WO | 2009039349 | A1 | 3/2009 |

OTHER PUBLICATIONS

Search Report and Written Opinion from corresponding EP Application No. 11191857.9-1610 dated Mar. 1, 2013.

* cited by examiner

*Primary Examiner* — Matthew Buck
*Assistant Examiner* — Aaron Lembo
(74) *Attorney, Agent, or Firm* — Bracewell & Giuliani LLP

(57) ABSTRACT

Methods and systems for a backup emergency disconnect signal (EDS) transmission in an offshore oil and gas installation are provided. A backup EDS transmission system includes a pressure pulse generator located close to a water surface and configured to generate a predetermined pressure variation pattern including at least one of positive and negative pressure pulses and corresponding to an emergency disconnect signal, the signal being propagated downwards in a mud column. The pressure pulse generator is located at a surface end of the mud column. The backup EDS transmission system also includes a pressure pulse receptor connected to a controller of blowout preventers and configured to measure a pressure in the mud column, at a subsea location.

14 Claims, 6 Drawing Sheets

DEVICES AND METHODS FOR TRANSMITTING EDS BACK-UP SIGNALS TO SUBSEA PODS

BACKGROUND

1. Technical Field

Embodiments of the subject matter disclosed herein generally relate to devices and methods for transmitting backup emergency disconnect signals (EDS) to subsea pods configured to control blowout preventers.

2. Discussion of the Background

Oil and gas extraction remains a critical component of the world economy in spite of increasing challenges regarding the accessibility of the oil reserves and the safety of the exploitation. Thus, drilling at offshore locations to extract oil and gas from under the sea floor is widely used worldwide. Subsea oil and gas exploration becomes even more challenging as sea depth at the well locations increases.

An offshore oil and gas installation 1 includes a subsea blowout preventer stack useable to seal a wellhead for safety and environmental reasons. As shown in FIG. 1, the subsea blowout preventer stack includes a lower blowout preventer ("BOP") stack 10 attached to a wellhead on the sea floor 20, and a Lower Marine Riser Package ("LMRP") 30, which is attached to a distal end of a drill string 40. The drill string 40 extends from a drill ship 50 (or any other type of surface drilling platform or vessel) towards the wellhead. During regular operation the lower BOP stack 10 and the LMRP 30 are connected. At times, blowout preventers 25 located in the lower BOP stack 10 and in the LMRP 30 may be closed. The LMRP 30 may be disconnected from the lower BOP stack 10 and retrieved to the surface, leaving the lower BOP stack 10 atop the wellhead, on the sea floor 20. Thus, for example, the LMRP 30 may be disconnected and retrieved when inclement weather is expected or when use of the wellhead is temporarily stopped.

Electrical cables and/or hydraulic lines 60 transport control signals from the surface (i.e., the drill ship 50) to two pods 70 and 75 which are part of the LMRP 30. The two pods 70 and 75 control the BOPs and other devices in the LMRP 30 and the lower BOP stack 10 according to signals received from the surface (i.e., the drill ship 50). The two pods 70 and 75, known as the "yellow" pod and the "blue" pod are substantially identical and ensure redundancy (i.e., if one fails, the other takes over).

Upon receiving an EDS signal, the pod(s) 70 and/or 75 control closing of the BOPs of the LMRP 30 and the lower BOP stack 10. However, the EDS signal may not reach the pods 70 and 75 when the electrical cables 60 are unintentionally interrupted. In order to receive the control signals at the pod(s), physical continuity of the electrical cables 60 is necessary. However, the electrical cables 60 may have been interrupted accidentally when an emergency situation triggering the necessity to send an EDS signal from the surface to the pod(s) 70 and/or 75 occurs. If the EDS signal does not reach the pod(s) 70 and/or 75 and the BOPs are not closed, the consequences may be dire for the operating personnel, the equipment and the environment.

In some installations, an acoustic backup EDS signal may be transmitted acoustically via the sea water. However, when a distance between the water surface and the LMRP is large, this acoustic backup EDS signal may be dumped and lost. In addition environmental interference in the sea water due to the emergency situation occurring could prevent the acoustic backup EDS signal from being received properly subsea.

Accordingly, it would be desirable to provide a backup transmission of the EDS signal from the surface to pods attached to the LMRP, using another path than the electrical cables and/or water column.

SUMMARY

According to one exemplary embodiment, a backup emergency disconnect signal (EDS) transmission system useable in an offshore oil and gas installation is provided. The system includes a pressure pulse generator configured to generate at least one of positive and negative pressure pulses to form a predetermined pressure variation pattern corresponding to an emergency disconnect signal, in fluid flowing in a mud column inside a drill string, the pressure pulse generator being located at a surface end of the mud column. The system further includes a pressure pulse receptor configured to measure a pressure of the fluid flowing in the mud column, at a subsea location close to blowout preventers.

According to one exemplary embodiment, an offshore oil and gas installation includes a surface drilling platform or vessel, a lower blowout preventer (BOP) stack attached to a wellhead located on a sea floor, and configured to interrupt a fluid flow from the wellhead, and a lower marine riser package (LMRP) detachably attached to the lower BOP stack. The offshore oil and gas installation further includes a drill string configured to allow the fluid flow between the wellhead and the surface drilling platform or vessel through at least one mud column, a subsea controller attached to the LMRP, and configured to shutdown blowout preventers located in the lower BOP stack and the LMPR upon receiving and an emergency signal (EDS), and an electric communication line configured to transmit the EDS from the surface drilling platform or vessel to the subsea controller. The system further includes a pressure pulse generator configured to generate at least one of positive and negative pressure pulses to form a predetermined pressure variation pattern corresponding to the EDS, in the fluid flow in the mud column inside the drill string, the pressure pulse generator being located at a surface end of the mud column, and a pressure pulse receptor connected to the subsea controller and configured to measure a pressure of the fluid flow in the mud column.

According to another embodiment, a method for a backup transmission of an Emergency Disconnect Signal (EDS) is provided. The method includes (i) generating a pressure variation pattern corresponding to the EDS, at a first location, which is close to a surface end of a mud column in a drill string, (ii) measuring pressure values in the mud column, at a second location, which is close to blowout preventers, identifying the pressure variation pattern corresponding to the EDS based on the pressure values, and transmitting the EDS to a controller configured to close the blowout preventers.

BRIEF DESCRIPTION OF THE DRAWINGS

The accompanying drawings, which are incorporated in and constitute a part of the specification, illustrate one or more embodiments and, together with the description, explain these embodiments. In the drawings:

FIGS. 2*b* and 2*c* are cross-sectional views through a fluid and a mud pipe of an offshore rig according to exemplary embodiments;

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of an offshore rig. However, the embodiments to be discussed next are not limited to the offshore rigs, but may be applied to other systems that require a backup path for transmitting an emergency signal and have a fluid transmission medium available.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
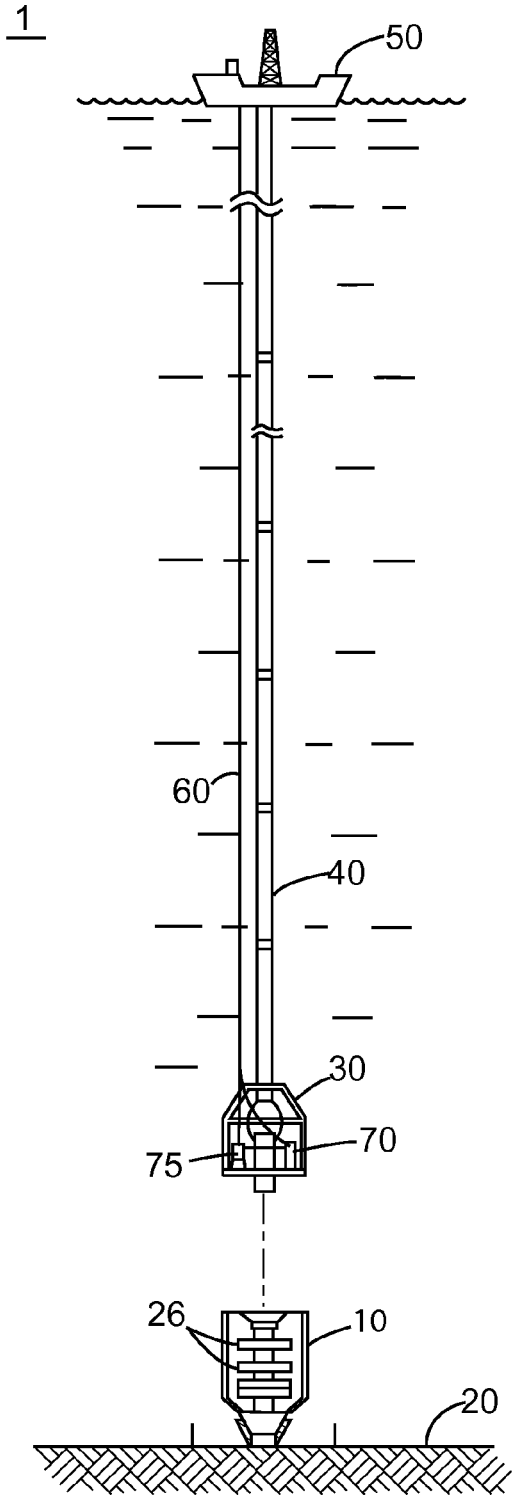
Figure 1 (Background Art)
FIG. 1 is a schematic diagram of a conventional offshore rig.
Figure 2A:
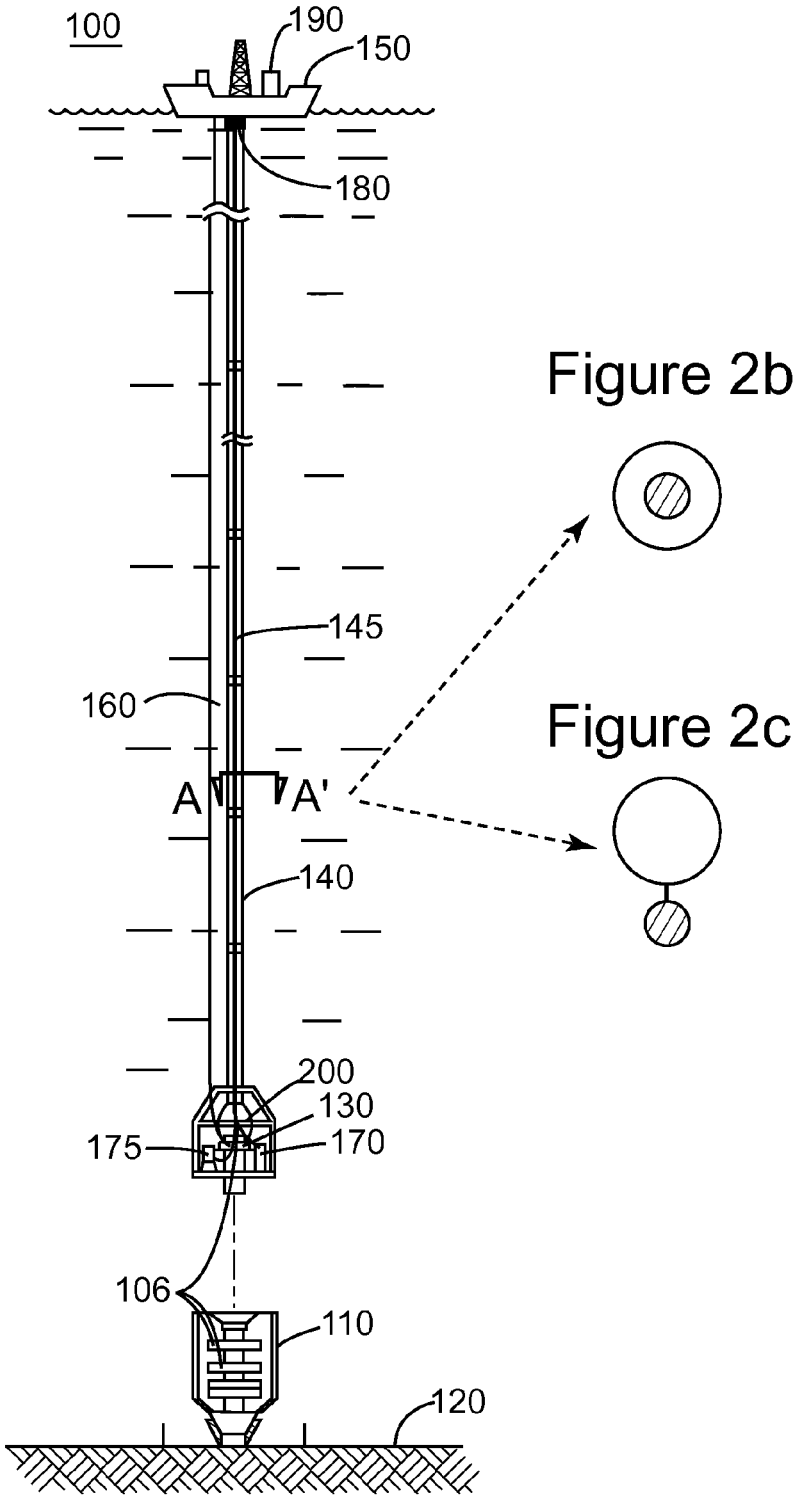
FIG. 2*a* is a schematic diagram of an offshore rig according to an exemplary embodiment.

An offshore rig 100 according to an exemplary embodiment is illustrated in FIG. 2*a*. The offshore rig 100 includes plural layers of blowout preventers 106 useable to seal (i.e., interrupt a fluid flow from) the wellbore for safety and environmental reasons. The blowout preventers 106 are located on a lower blowout preventer ("BOP") stack 110 attached to the wellhead on the sea floor 120, and on a Lower Marine Riser Package ("LMRP") 130 attached to a distal end of a fluid pipe 140. The fluid pipe 140 may include a drill riser, drill casing, drill pipe, drill tools or anything required during drilling operations. A fluid flows or fills the fluid pipe 140 between the wellhead and a surface drilling platform or vessel 150. For example, during drilling, mud may be pumped from the surface drilling platform or vessel 150 to the wellhead through the drill string and may return flowing through an annulus formed by the exterior of the drill string and the interior of the drill riser. When the LMRP 130 is engaged with the lower BOP stack 110, all the blowout preventers 106 are controlled by any one of two redundant pods 170 and 175 attached to the LMRP 130 based on control signals received from the surface drilling platform or vessel 150 via electrical cables 160. Frequently, the offshore rigs include two substantially identical pods to ensure redundancy, but the current inventive concept is applicable also for an offshore rig having a single pod.

The control signals received by the pod(s) 170 and/or 175 from the surface include an Emergency Disconnect Signal (EDS), which is transmitted in emergency situations. Upon receiving the EDS signal, the pod(s) 170 and/or 175 determine the closing of the BOPs in the BOP stack 110 and the LMRP 130. As long as the physical continuity of the electrical cables 160 between the pods 170 and 175 and the surface is maintained, the pods 170 and 175 receive the control signals. However, when the electrical cables 160 are interrupted, the control signals transmitted using the electrical cables 160 may not reach the pod(s) 170 and 175. Therefore, if the electrical cables 160 are interrupted, the EDS signal may be sent towards the pod(s) 170 and 175 via a mud column 145 located inside (as illustrated in FIG. 2*b*) or outside (as illustrated in FIG. 2*c*) of the fluid pipe 140. In an alternative embodiment, the EDS signal may always be sent via a mud column 145 located inside the fluid pipe 140, even if the electrical cables 160 are not known to be interrupted.

A fluid circulating in at least one column in the fluid pipe 140 is known as mud, which is a term that encompasses most fluids used in oil and gas drilling operations, especially fluids that contain significant amounts of suspended solids, emulsified water or oil. Mud includes all types of water-base, oil-base and synthetic-base drilling fluids. Transmitting data through mud, known as mud pulse telemetry, is a communication method used by some Measurements While Drilling (MWD) systems for transmitting data from a downhole tool used during drilling, to the surface. Different from the mud pulse telemetry, according to an aspect of some embodiments, an EDS signal is transmitted from the surface, to the pod(s) 170 and/or 175 through the mud. Depending of particular designs and purposes, a fluid pipe 140 includes one or more mud columns in various configurations. However, applicability of the communication from the surface to the pods via mud is not limited by a particular design.

Figure 3A:
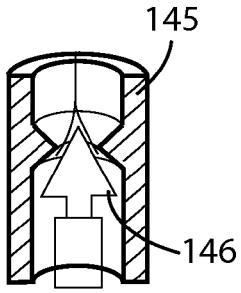
FIGS. 3*a*, 3*b*, and 3*c* illustrate a pressure pulse generator useable in one exemplary embodiment and the pressure pulse generator's operation.
Figure 3B:
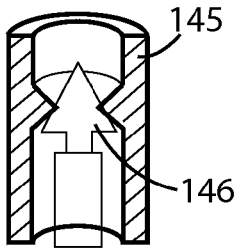
Figure 3C:
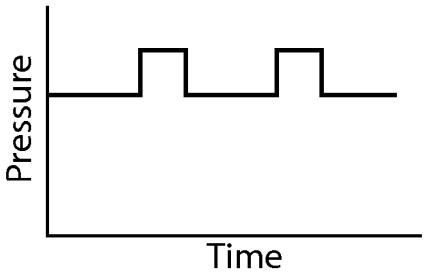

To generate a backup EDS to be transmitted via a mud column 145, a pressure pulse generator 180 is installed close to an upper end of the mud column 145, at or near the surface drilling platform or vessel 150. An embodiment and operation of a pressure pulse generator is illustrated in FIG. 3. FIGS. 3*a* and 3*b* illustrate a pressure pulse generator including a valve 146 located inside a mud column 145. The valve 146 may be in an open position as in FIG. 3*a* or in a closed position as in FIG. 3*b*. By switching between the open and the close positions with a predetermined frequency a pressure variation pattern as illustrated in FIG. 3*c* may be achieved (the lower pressure corresponding to the open position and the higher pressure corresponding to the closed position). In an alternative embodiment, the pressure pulse generator may include a vent which may create negative pressure pulses in a mud column, by venting the mud temporarily, according to the signal frequency. In another embodiment, a membrane inside the mud column may oscillate.

The positive or negative pressure pulses generated by the pressure pulse generator 180 form a pressure variation pattern corresponding to the EDS. The pressure generator 180 is connected to at least one computer 190 configured to send an EDS trigger signal to the pressure pulse generator 180. The computer 190 may send the EDS trigger signal automatically, or may sent the EDS trigger signal following an operator's request.

Figure 4:
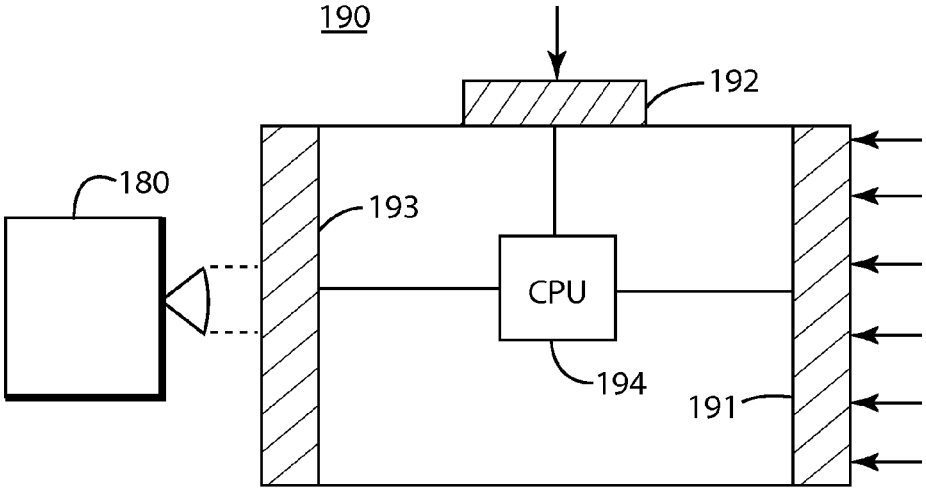
FIG. 4 is a schematic diagram of a computer configured to send an EDS trigger signal to a pressure pulse generator according to an exemplary embodiment.

An exemplary embodiment of the computer 190 is illustrated in FIG. 4, and includes a process monitoring interface 191 configured to receive data from monitoring the rig operation, an operator interface 192 configured to allow an operator to enter manually commands including emergency shutdown command requiring sending and EDS signal to the pod(s), a pressure pulse generator interface 193 to send a signal triggering transmission of an EDS pressure pulse pattern by the pressure pulse generator 180, and a central processing unit 194 connected to the interfaces 191, 192, and 193 and determining operation of the computer according to received signals and commands.

Returning now to FIG. 2*a*, the pressure variation pattern corresponding to the EDS is transmitted via the mud column 145 located inside the fluid pipe 140. A speed of propagating the pressure signal through the mud column is of the order of hundreds of meters per second (m/s). Data rates through a mud column are few bits per second (b/s), corresponding to a signal frequency of few Hz. The signal frequency is selected to be distinct from frequencies of naturally occurring background signals.

A pressure transducer 200 located in the proximity of the pod(s) 170 and 175 measures the pressure in the mud column. The pressure transducer 200 may be located in a cavity of a BOP located on the LMRP 130 or in the lower BOP stack 110. The pressure transducer 200 is connected via cable to the pod(s) 170 and/or 175. Thus, the pressure transducer 200 is configured to measure the pressure in the mud column at the surface end of which it is mounted the pressure pulse generator 180. The pressure transducer 200 may be configured to analyze measured pressure values and to identify the pressure variation pattern corresponding to the EDS. Upon identifying the pressure variation pattern corresponding to the EDS, the pressure transducer 200 may be further configured to send the EDS to the pod(s) 170 and/or 175. In an alternative embodiment, the pressure transducer 200 may send the measured pressure values to the pod(s) 170 and/or 175, and the pod(s) 170 and/or 175 may be configured to analyze the pressure values and to identify the pressure variation pattern corresponding to the EDS.

Figure 5:
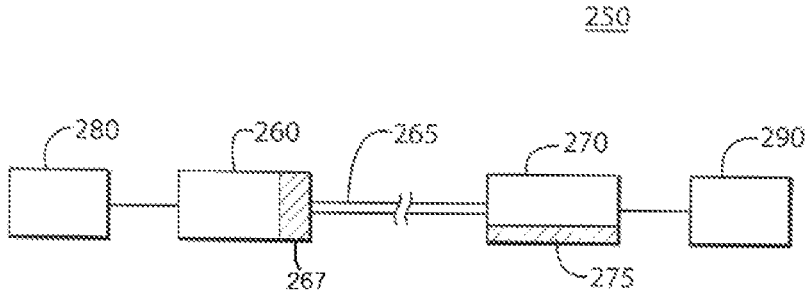
FIG. 5 is a schematic diagram of a backup EDS transmission system according to another exemplary embodiment.

Focusing now on a backup EDS transmission system 250 useable on an offshore oil and gas installation as illustrated in FIG. 5, the system 250 includes a pressure pulse generator 260 (e.g., with a vent 267) configured to generate a predetermined pressure variation pattern including at least one of positive and/or negative pressure pulses and corresponding to the EDS signal, at a surface end of a mud column 265. The system 250 also includes a pressure pulse receptor 270 configured to measure a pressure of mud in the mud column 265, at a location close to blowout preventers (BOPs). The pressure pulse receptor 270 is connected to a (at least one) pod 290 controlling the BOPs. The pulse receptor 270 may include a data processing unit 275 configured to identify the predetermined pressure variation pattern corresponding to the EDS signal based on the measured pressure values and to forward the EDS signal to the at least one pod 290.

The pressure pulse generator 260 may be connected to a surface controller 280 by wire or wirelessly. The surface controller 280 may be configured to send an EDS transmission trigger signal to the pressure pulse generator 260, automatically, when an emergency situation is identified, or upon receiving a command from an operator.

The pulse receptor 270 may be connected to the pod 290 via wire. Upon receiving the EDS signal, the pod 290 operates to close the BOPs.

Figure 6:
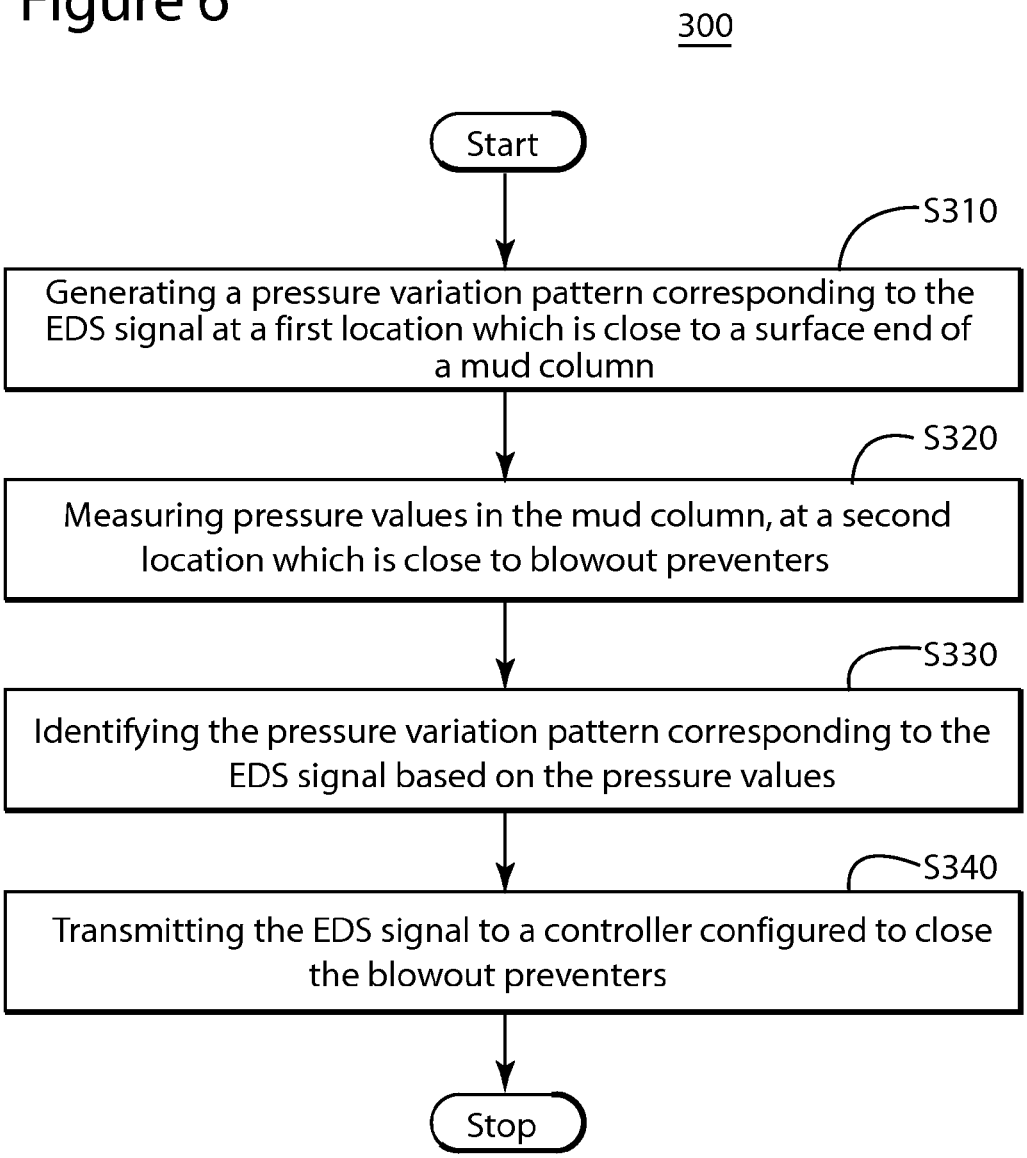
FIG. 6 is a flow diagram of a method for a backup transmission of an Emergency Disconnect Signal (EDS) according to another exemplary embodiment.

FIG. 6 illustrates a flow diagram of a method 300 for a backup transmission of an EDS signal. The method 300 includes generating a pressure variation pattern corresponding to the EDS signal, at a first location, which is close to a surface end of a mud column at S310. Further, the method 300 includes measuring pressure values in the mud column at a second location, which is close to blowout preventers at S320. The method 300 also includes identifying the pressure variation pattern corresponding to the EDS signal based on the pressure values at S330, and transmitting the EDS signal to a controller configured to close the blowout preventers at S340.

The disclosed exemplary embodiments provide systems and methods for transmitting an EDS signal from the surface to a subsea blowout preventer controller via a mud column in a fluid pipe. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. An offshore drilling assembly, comprising:

a drilling riser containing a fluid column and having an upper end configured for support by a drilling vessel;

a subsea blowout preventer assembly having a blowout preventer (BOP) stack for securing to a subsea wellhead and a lower marine riser package (LMRP) detachably attached to an upper end of the BOP stack, the LMRP being connected to a lower end of the drilling riser;

a subsea controller mounted to the blowout preventer assembly and hydraulically connected with the BOP stack for controlling various functions of the BOP stack, including blocking upward flow through the drilling riser;

an electrical line extending from the subsea controller for connection to the drilling vessel for providing signals to the subsea controller;

a backup system to block upward flow through the drilling riser in the event signals to the subsea controller via the electrical line are interrupted, comprising:

a pressure pulse generator located within the drilling riser close to an upper surface of the fluid column and configured to generate a predetermined pressure variation pattern corresponding to an emergency disconnect signal (EDS) and including at least one of positive and negative pressure pulses, the signal being propagated downwards in the fluid column;

a pressure pulse receptor mounted to the blowout preventer assembly and configured to sense pressure variations in the fluid column at the blowout preventer assembly;

a subsea data processor electrically connected with the receptor for determining whether pressure variations sensed by the pressure pulse receptor comprise the pressure variation pattern propagated by the pulse generator corresponding to the EDS; an wherein the data processor is electrically connected with the subsea controller to cause the subsea controller to block upward flow through the riser upon determining the pressure variation pattern corresponding to the EDS was detected by the pulse receptor.

2. The offshore drilling assembly of claim 1, wherein the pressure pulse receptor is mounted within a cavity of a blowout preventer of the blowout preventer assembly.

3. The offshore drilling assembly of claim 1, wherein the drilling riser comprises a central conduit for the passage of a drill string and at least one auxiliary conduit alongside and parallel to the central conduit, and wherein the pulse generator propagates the pressure variation, pattern down the central conduit.

4. The offshore drilling assembly of claim 1, further comprising a surface controller adapted to be mounted to the drilling vessel and electrically connected to the pressure pulse generator, the surface controller being configured to send an EDS transmission trigger signal to the pressure pulse generator to cause the pressure pulse generator to generate the pressure variation pattern.

5. The offshore drilling assembly of claim 4, wherein the surface controller has a process monitoring interface that monitors operational conditions of the oil and gas installation and causes the surface controller to send the EDS transmission trigger signal to the pressure pulse generator when operational conditions indicate such is needed.

6. The offshore drilling assembly of claim 1, wherein the pressure pulse generator includes a valve placed in the fluid column, and is further configured to generate the predetermined pressure variation pattern by opening and closing the valve.

7. The offshore drilling assembly of claim 1, wherein the pressure pulse generator includes a vent placed inside the fluid column, and is further configured to generate the predetermined pressure variation pattern by venting the fluid in the fluid column using the vent.

8. An offshore drilling assembly, comprising:

a lower blowout preventer (BOP) stack adapted to be attached to a wellhead located on a sea floor, and configured to interrupt a fluid flow from the wellhead;

a lower marine riser package (LMRP) detachably attached to the lower BOP stack;

a drilling riser connected to the LMRP and extending upward for support by a surface drilling platform or vessel, the drilling riser being filled with a fluid;

a subsea controller attached to the LMRP, and configured to close at least one blowout preventer located in the lower BOP stack upon receiving an emergency disconnect signal (EDS);

an electric line configured to transmit the EDS from the surface drilling platform or vessel to the subsea controller;

a back-up system in the event the EDS is unable to be transmitted via the electric line to the subsea controller, comprising:

a pressure pulse generator located within the drilling riser adjacent an upper end of the drilling riser and configured to generate a predetermined pressure variation pattern corresponding to the EDS and including at least one of positive and negative pressure pulses, the pressure variation pattern being propagated downwards through the fluid in the drilling riser;

a pressure pulse receptor mounted to the LMRP and in fluid communication with the fluid in the drilling riser for detecting pressure variations in the fluid;

a subsea data processing unit that analyzes the pressure variations detected by the pressure pulse receptor to determine whether the pressure variations detected by the pressure pulse receptor comprise the pressure variation pattern corresponding to the EDS; and wherein the data processing unit is electrically connected to the subsea controller to signal the subsea controller to close the at least one blowout preventer in the event the pressure variation pattern corresponding to the EDS is received.

9. The offshore drilling assembly of claim 8, wherein the pulse receptor is mounted within a cavity of one of the at least one blowout preventers.

10. The offshore drilling assembly of claim 8, wherein the drilling riser comprises a central conduit for the passage of a drill string and at least one auxiliary conduit extending alongside and parallel to the central conduit, and wherein the pulse generator propagates the pressure variation pattern down the central conduit.

11. The offshore drilling assembly of claim 8, further comprising:

a surface controller adapted to be mounted to the surface drilling platform or vessel, the surface controller being electrically connected to the pressure pulse generator and configured to send an EDS transmission trigger signal to the pressure pulse generator to cause the pressure pulse generator to generate the pressure variation pattern.

12. The offshore drilling assembly of claim 11, wherein the surface controller has a process monitoring interface that monitors operational conditions of the oil and gas installation and is further configured to send the EDS transmission trigger signal to the pressure pulse generator in response to the operational conditions monitored.

13. The offshore drilling assembly of claim 8, wherein the pressure pulse generator comprises at least one of a valve and a vent, and is further configured to generate the predetermined pressure pattern by performing at least one of opening and closing the valve, and venting the fluid in the fluid in the riser using the vent.

14. A method for a backup transmission of an Emergency Disconnect Signal (EDS) for an offshore drilling riser assembly comprising:

a drilling riser containing a fluid column and having an upper end configured for support by a drilling vessel;

a subsea blowout preventer assembly having a blowout preventer (BOP) stack for securing to a subsea wellhead and a lower marine riser package (LMRP) detachably attached to an upper end of the BOP stack, the LMRP being connected to a lower end of the drilling riser;

a subsea controller mounted to the blowout preventer assembly and hydraulically connected with the BOP stack for controlling various functions of the BOP stack, including blocking upward flow through the BOP stack; and an electrical line extending from the subsea controller for connection to the drilling vessel for providing the EDS to the subsea controller;

the method comprising:

in the event the EDS sent via the electrical line is interrupted, generating a pressure variation pattern corresponding to the EDS in the riser at a point close to an upper end of the fluid column;

with a pressure pulse receptor, detecting pressure variations in the fluid column at the blowout preventer assembly;

with a subsea data processor, identifying whether the pressure variations detected comprise the pressure variation pattern corresponding to the EDS; and if so, with the data processor, electrically communicating with the subsea controller to cause the BOP stack to block upward flow through the BOP stack.

* * * * *

UNITED STATES PATENT AND TRADEMARK OFFICE

CERTIFICATE OF CORRECTION

PATENT NO. : 8,511,388 B2
APPLICATION NO. : 12/969822
DATED : August 20, 2013
INVENTOR(S) : Milne It is certified that error appears in the above-identified patent and that said Letters Patent is hereby corrected as shown below:

In the Claims:

In Column 6, Line 64, in Claim 1, delete “an” and insert -- and --, therefor.

In Column 7, Line 10, in Claim 3, delete “variation,” and insert -- variation --, therefor.

Signed and Sealed this
Third Day of June, 2014

Michelle K. Lee

Michelle K. Lee
*Deputy Director of the United States Patent and Trademark Office*